US005592861A

United States Patent [19]

Barmore

[11] Patent Number: 5,592,861

[45] **Date of Patent: *Jan. 14, 1997**

[54] SOCKET WRENCH SET

[76] Inventor: Thomas C. Barmore, 4N 127 Verrill, Addison, Ill. 60101

[ * ] Notice: The portion of the term of this patent subsequent to Jun. 7, 2011, has been disclaimed.

[21] Appl. No.: 71,057

[22] Filed: Jun. 4, 1993

[51] Int. Cl.[6] ..... B25B 23/00

[52] U.S. Cl. ..... 81/438; 81/124.6

[58] Field of Search ..... 81/124.5, 124.6, 81/437–439

[56] References Cited

U.S. PATENT DOCUMENTS 3,733,938 5/1973 Smith ..... 81/124.5 X
3,878,740 4/1975 Gotshall ..... 81/124.6
4,242,932 1/1981 Barmore ..... 81/437
4,982,632 1/1991 Barmore ..... 81/438
5,127,289 7/1992 Lanham ..... 81/437 X

*Primary Examiner*—James G. Smith
*Attorney, Agent, or Firm*—Paul H. Gallagher

[57] ABSTRACT

A socket having a recess in its front end fitted over a nut or bolt head, and an internal key, smaller than the recess, slidable in the socket forwardly through the socket to the exterior. The key fits in an internal socket in the nut or bolt head, and is retracted automatically in cases where there is no internal socket in the nut or bolt head. Two forms are disclosed, in one, the internal is insertable into and removed from the socket through the rear end, and in the other, through the front end. In one form, the socket can be used in the case where a nut is run down on a bolt a great distance, leaving a long extension of the bolt beyond the nut.

12 Claims, 1 Drawing Sheet

SOCKET WRENCH SET

SUMMARY OF THE INVENTION

The invention resides in the field of socket wrench sets, wherein a series of sockets are provided for a single drive tool. The sockets are shaped and dimensioned at one end to fit the same drive tool, but are shaped and dimensioned at the other end individually to fit different size objects, such as nuts, bolt heads, etc., or provided with additional elements at the other end to fit the different objects.

The device of the invention is adaptable to many different forms of workpieces that have both external and internal surfaces to be engaged by the socket, for tightening or loosening them. The socket of the invention therefore has elements engageable with both those kinds of surfaces.

A main object of the invention is to provide such a device that is extremely simple in construction, and in use, and therefore economical, and has elements therein, that are brought into use, or not used, respectively, in certain circumstances, in an automatic sense, that is, without the need for special attention by the user.

BRIEF DESCRIPTION OF THE INDIVIDUAL FIGURES OF THE DRAWINGS

DETAILED DESCRIPTION

Figures 1, 2, 3, 4, 5, 6, 7, 8, 9, 10, 11, 12, 13, 14:
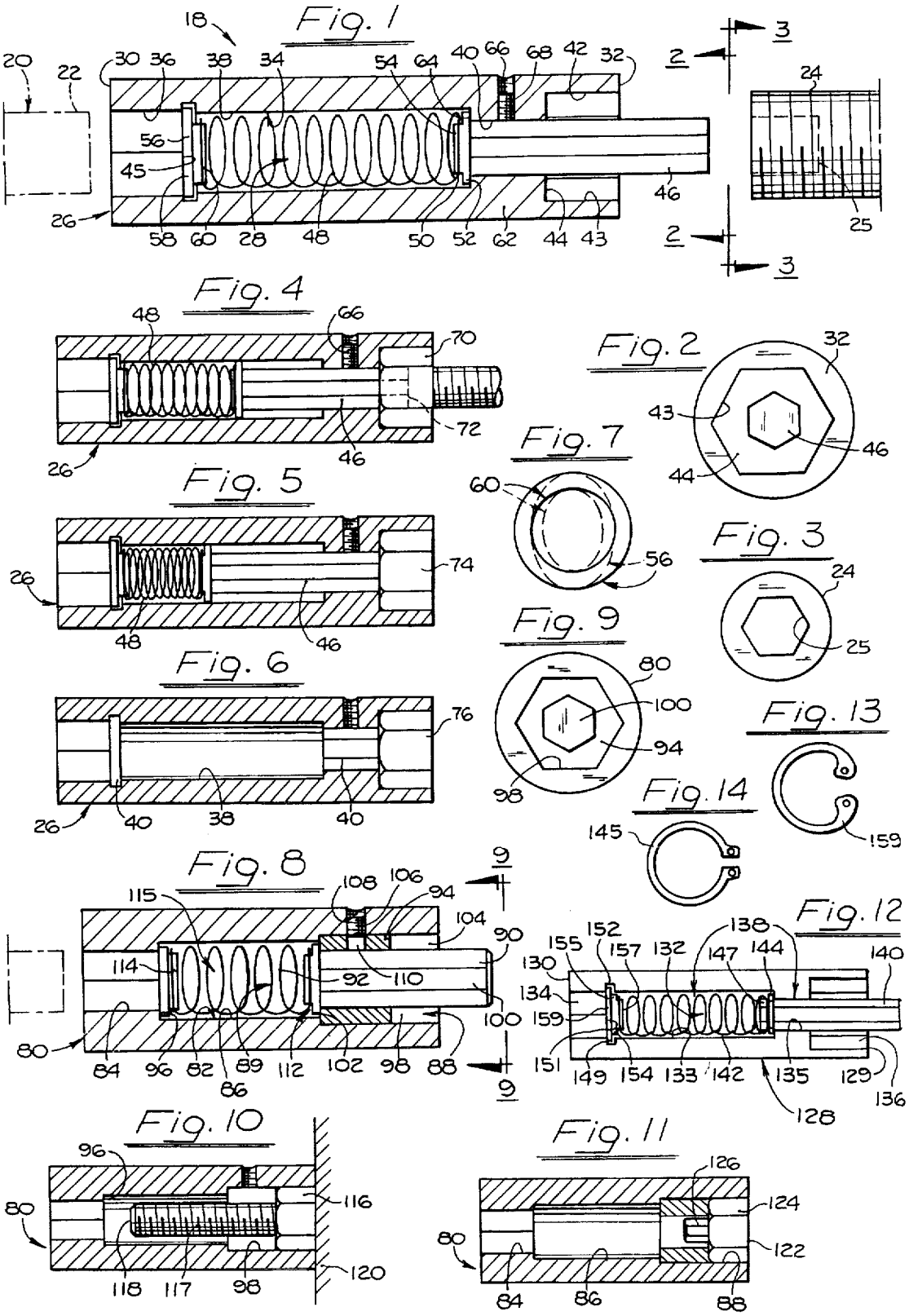
FIG. 1 is a longitudinal sectional view of the device of the invention, in association with a workpiece.
FIG. 2 is an end view taken at line 2—2 of FIG. 1.
FIG. 3 is an end view of the workpiece, taken at line 3—3 of FIG. 1.
FIG. 4 is a small scale view of the device showing a workpiece in the socket, and the internal key in active position
FIG. 5 is a view similar to FIG. 4 but with a different workpiece in the socket and with the key in retracted position.
FIG. 6 is a view of the socket with a workpiece therein, and the key removed.
FIG. 7 is a face view of a retainer means
FIG. 8 is a large scale view, similar to FIG. 1, of a second form of device.
FIG. 9 is an end view taken at line 9—9 of FIG. 8.
FIG. 10 is a view of the device of FIG. 8 used as a deep well socket.
FIG. 11 is a view of the device of FIGS. 8–10 with a nut therein having two surfaces
FIG. 12 shows a form modified relative to the form of FIGS. 1–8.
FIG. 13 shows a snap ring used in the device of FIG. 12.
FIG. 14 shows another snap ring used in the device of FIG. 12.

Disclosed herein are three forms of device embodying the invention. One form is disclosed in FIGS. 1–7 and a second form in FIGS. 8–11, and a third form in FIGS. 12–14.

Referring to the invention in general, it is pointed out that the socket of the invention is particularly adapted for engaging external surfaces, and internal surfaces, selectively, of a workpiece, this being accomplished by a single socket of extremely simple construction.

Referring in detail to the drawings, and referring first to FIGS. 1–7, FIG. 1 shows a socket wrench unit 18 for use with a drive tool indicated generally at 20 and represented by the rotatable drive element 22 thereof. The socket wrench unit is adapted for use with, or for operating or working, a workpiece indicated generally at 24, and which may be a nut, bolt head, screw, etc. The workpiece of course is a standard element, and may be referred to also generically as a fastener. In the present case the workpiece 24 is an allen head screw having an internal recess socket 25.

The socket wrench unit 18 includes a socket 26 and an inner drive unit 28. The socket 26 is a socket member, or socket element, but generally in the trade it is known simply as a socket, and will be so referred to herein. The socket has a rear end 30 and a front end 32, and has a longitudinal hole 34 extending therethrough from end to end, to the exterior, which is made up of a plurality of segments, in this case four, namely a rear recess 36 at its rear end, a main central segment 38, a small segment 40 and a front recess 42 at the front end.

The rear recess 36 is polygonal in shape, to receive the drive element 22 of the drive tool. The main central segment 38 may be cylindrical in shape; the small segment 40 is polygonal, preferably hexagonal; and the front recess 42 is also polygonal, preferably hexagonal, but larger than the small segment 40 and has internal surface 43 and a rear end surface 44.

At the conjuncture of the rear recess 36 and the main segment 38 is a circumferential internal groove 45.

The inner drive unit 28 is made up of a drive element 46 and a compression spring 48. The inner drive element 46 may be referred to as a key and has a polygonal external surface, preferably hexagonal. At the rear or inner end of the key is a head 50 including a large diameter circumferential bead 52 and a reduced diameter boss 54.

The spring 48 is positioned in the main segment 38 of the hole and compressed between the head 50 and a retainer 56, which includes a large diameter bead 58 and a reduced diameter boss 60 extending forwardly. The retainer 56 is semi-flexible, and may be made of suitable material such as plastic, and possesses a considerable degree of rigidity, but is sufficiently flexible (FIG. 7) for it to be snapped into the groove 45. The retainer is thus locked in the groove and normally prevented from falling out. The spring 48 may be centered on the bosses 54, 60, or it may be dimensioned to be guided by the surface of the hole segment 38.

In assembling the elements, the retainer 56 at first is not positioned in the socket, and the inner drive unit including the key and the spring are inserted into the socket from the rear, and then the retainer 56 is snapped into place in the groove, and normally held therein and it prevents the spring and key from being displaced or moved out of the rear end of the hole.

The socket 26 itself is a one-piece, integral member, and has an inwardly thickened portion 62 which forms the small hole 40, and it also forms a rearwardly facing shoulder 64 which the bead 52 of the head 50 engages, and the shoulder limits the forward movement of the key and expansion of the spring, and prevents both those elements from being removed through the front end of the hole. FIG. 1 shows the head 50 engaging the shoulder, in the forward limit position of the key, and this will be referred to as a full forward position. In this full forward position, the key 46 extends through the front recess 42, to the exterior.

A set screw 66 is threaded in a radial hole 68 and engageable with the key 46 for releasably securing the key it in longitudinally adjusted position.

The dimensions and proportions of the various elements are such that the key can be moved rearwardly against the spring 48 to a full retracted position in which the front end of the key is flush with the rear end surface 44 of the front recess 42 (FIG. 4, see below.) In the full retracted position of the key, the compression spring is correspondingly compressed.

FIG. 1 represents the use of the socket in one phase or step. In its normal condition, the set screw 66 may be retracted and the socket used in several kinds of steps with it so retracted. In this normal condition of the socket, the key 46 is extended forwardly (FIG. 1) and it is simply fitted in the recess 25 of the allen head screw, and turned about a longitudinal axis. There is no need in this step to lock the key by the set screw 66, and the socket is merely fitted to the allen head, and the socket is pushed sufficiently to hold the key steady in contact engagement. If additional pressure is imposed, no harm will be done, and the key will simply be retracted into the socket a corresponding amount, but the key will be held firmly in the socket in the screw. The tool is then operated and the screw iS turned, to turn it in or to remove it. When that is accomplished, the socket is simply removed from the screw, and the key remains in extended position ready for use in another step. It will be appreciated of course that in this manipulation the front recess 42 of the socket does not come into play, and it is not required to be used.

FIG. 4 represents the tool used on a bolt head 70 having a rear or top socket 72. This bolt head thus has an external surface and an inner surface. In this case, the socket is applied to the bolt head, in the normal condition of the socket as in FIG. 1, by inserting the key into the recess 72, and continually moving the socket toward the bolt head, the front recess being fitted over the bolt head. The front recess is dimensioned longitudinally, such that the bolt head engages the rear end surface 44 of the recess, and its other end is preferably flush with the front end of the socket. In this step, as the socket is moved to the bolt head, or relatively speaking as the bolt head enters the front recess, the key is moved rearwardly, in retracting direction, although fitted in the recess in the bolt head, and is so moved a corresponding amount, to the position shown in FIG. 4. This movement of the key is a direct result of the fitting of the socket on the bolt head, and may be considered as an automatic movement, in the sense that no special manipulation must be performed by the user to accomplish the fitting of the socket on the bolt head.

FIG. 5 represents a step similar to that of FIG. 4, but in the case of FIG. 5, a nut or bolt head 74 is shown which does not have a recess such as 72. The socket is applied to the nut in the same manner as in the case of FIG. 4, and the key simply engages the end of the nut, and is pushed into the socket a corresponding greater amount. This movement of the key may also be considered automatic.

FIG. 6 represents the socket with the inner drive unit 28 removed, as well as the set screw 66. In this case the socket 26 is used by merely fitting it on the nut or bolt head, indicated at 76, and turned.

Thus the socket 18 of FIGS. 1–7 can be used in three different ways, namely utilizing the external surface of the key (FIG. 1) in the internal surface of the recess 25 of the screw; in the case of the nut or bolt head 70, (FIG. 4) both the internal surface of the front recess, and the external surface of the key, engage corresponding external and internal surfaces in the bolt head; and in the case of the nut or bolt head 74 (FIG. 5) that does not have a recess, by using only the internal surface of the front recess on the external surface of the bolt.

The form of device shown in FIGS. 8–11 is generically Similar to that of FIGS. 1–7. In the present case (FIGS. 8–11) the socket indicated at 80 has a longitudinal hole 82 extending therethrough. The hole is made up of a plurality of segments, in this case three, namely a rear recess 84, a main central segment 86, and a front long recess 88.

Within the socket is an internal drive unit 89 including a drive element or key 90 and a compression spring 92. Additionally a wafer 94 is positioned in front long recess.

The rear recess 84 is adapted for receiving the drive element of a drive tool and the main segment 86 which may be cylindrical, is of diameter greater than the transverse dimension of the recess 84, forming a forwardly facing shoulder 96.

The front long recess 88 has a polygonal inner surface 98, preferably hexagonal in shape, and the key 90 has an external polygonal surface 100, preferably hexagonal. The key is of substantially smaller transverse dimension than the recess.

The wafer 94 is removably positioned in the front long recess, and has an exterior polygonal surface complementary to the surface 98, and an internal polygonal surface complementary to the key. The main segment 86 is so dimensioned as to form a forwardly facing shoulder 102, and the wafer is fitted in the front recess and moved rearwardly to engage the shoulder which limits that movement. The wafer and the front recess are so dimensioned that when the wafer is so positioned, it terminates forwardly short of the front end of the recess, leaving a front free terminal recess 104 which is utilized for receiving a bolt head.

If desired a set screw 106 may be utilized, threaded in a radial hole 108 and extending into the front long recess and engageable in a hole 110 in the wafer, to hold the wafer in position longitudinally.

The inner end of the key 90 has a head 112 similar to the head 50 referred to above, and at the rear of the socket is a retainer 114 similar to the retainer 56, the compression spring 92 being compressed between these two members.

In assembling the elements in the socket (FIG. 8), in the beginning, the wafer 94 is not in place. The key and the compression spring, with the retainer 114, which together may also be identified as an inner drive unit 115, are inserted into the socket, and later removed therefrom through the front, relative to the position shown in FIG. 8. After the inner drive unit is in the socket, the wafer 94 is inserted, and moved rearwardly until it engages the shoulder 102, in which position the hole 110 is aligned with the set screw 106. The set screw may then be run into locking position, if desired. In this step the wafer pushes the key rearwardly, and the head of the key consequently bears against the wafer, and the wafer serves as a stop preventing the inner drive unit from being removed. FIG. 8 shows the key in full forward position, i.e., with the head 112 engaging the wafer, and in that position, the key 100 extends through the front socket, to the exterior.

The device of FIGS. 8–11, as thus described is generically similar to that of FIGS. 1–7, but it also possesses certain additional advantages. One of those advantages is that it can be used as a deep well socket. For this purpose, the inner drive unit 115 is removed, and the socket applied to a nut 116 (FIG. 10) that is turned down quite a distance beyond the end of the bolt 117, that end of the bolt being indicated at 118, referred to as the accessible end. In so applying the socket to a nut in such a situation, the bolt 117 extends outwardly from a machine element 120 and the nut run down tight against the machine element, leaving the e d of the bolt exposed, as shown. The socket is fitted over the bolt and engaged with the nut, and the internal surface 98 of the recess engages the external surface of the nut. The omission or removal of the inner drive unit 115 enables the bolt to extend up into the socket. It is pointed out that the use of the wafer 94 in this construction provides this advantage, i.e., the wafer 94 is removable, and space is provided for receiving the bolt in the socket.

Another advantage of the device of FIGS. 8–11 is represented in FIG. 11. In this case the socket is utilized with a nut 122 such as shown in FIG. 10 in the pending application identified above. In this case, the workpiece, i.e., nut, or bolt head, has a lower large element 124 and an upper small element 126, also referred to as two levels. In the use of the socket with such a nut or bolt head, the large portion is received in the free socket 104 and the small portion extends into the wafer. In this use of the socket, the inner drive element may or may not be removed, and in either case, the large portion is fully received in the front recess.

An advantage of the device of FIGS. 8–11 over that of FIGS. 1–7 is that the inner drive unit can be inserted into and removed from the hole, through the front end of the hole, in a very simple manner. The retainer 114 is not fixed in the socket, as is the retainer 56, and is easily removed through the front end.

FIGS. 12–14 show a further form embodying a socket similar to that of FIGS. 1–7. In the present case the socket 128 has a front end 129 and a rear end 130 and a longitudinal hole 132 therethrough, including a central main portion 133, a rear recess or cavity 134 for receiving the drive element of a drive tool. The hole further includes a small segment 135 hexagonal in shape and a front segment 136 forming a front recess or cavity.

Mounted in the hole is a drive unit 138 made up of two main parts, namely a drive pin or key 140 and a compression spring 142. The drive pin 140 is hexagonal complementary to the small segment 135 of the hole and has a circumferential groove 144 at its rear or inner end, and releasably snapped in the groove is a snap ring 145 forming a retainer (FIG. 14).

The hole 132 is originally cylindrical, and the rear cavity 134 is made polygonal as by broaching, and in the broaching step, a certain portion of the metal is displaced forwardly to a point 149, forming a forwardly facing shoulder 151. Immediately forwardly of this shoulder a circumferential groove 152 is preferably formed, although this groove is not essential.

Incorporated in the drive unit 138 is a rear retainer 154 which includes a rear and large flange 155 and a forwardly extending, reduced diameter boss 157.

The compression spring 142 is fitted on the drive pin 140, as noted above, and at its rear end is fitted on the boss 157. These two elements, the rear end of the drive pin and the boss element 157, function to retain the compression spring in its desired normal central position, although it is within the scope of the invention to retain the spring centered by the dimensioning of the segment 133 and the spring.

A rear retainer 159 (also FIG. 13) in the form of a snap ring is releasably snapped into position in the groove 152. The rear retainer 154 engages the snap ring and is held in position against being forced rearwardly out of the socket. In the case where the groove 152 is not utilized, the snap ring 159 fits against the shoulder 151.

This form of device, which is generally similar to the form of FIGS. 1–7, differs from that form in that a set screw, such as 66, is not necessary. The drive pin or key 140 does not have an enlarged head on its rear end, and thus it is less expensive to manufacture.

I claim:

1. A socket wrench unit for use with fasteners having heads of the kind having a first surface, and a second surface, and for those having only a said first surface, those surfaces being of regular polygonal shape, for engagement by sockets for turning the fastener about a longitudinal axis, comprising, a socket having a front end and a rear end and a longitudinal hole therethrough, the hole including a rear recess at the rear end for receiving a driving tool element, the hole also including a front recess at the front end with a polygonal internal surface, the hole also including a segment rearwardly of and smaller than the front recess, and having a polygonal internal surface, a key having an external polygonal surface complementary to the internal surface of the smaller segment of the hole, ad slidable therein to a full forward position in which it extends forwardly through the front recess to the exterior, and to a full retracted position in which its front end is at least as far rearwardly as the rear end of the front recess, said front recess, smaller hole, throughout their lengths in axial direction, and the key throughout its axial length from its front end rearwardly an extent of its range of movement between its forward and retracted positions, all being of uniform dimension, and said front recess being open and unencumbered except for the key, and yieldable spring means in the hole compressed between the key and a stop element of the socket adjacent the rear end of the hole, and biasing the key toward its full forward position.

2. A socket wrench unit according to claim 1 wherein, the hole includes a main central segment, the yieldable spring means is positioned in the main central segment, the socket has an internal circumferential groove at the juncture of the main central segment and the rear recess, and said retainer is of limited flexibility enabling it to be snapped into said groove.

3. A socket wrench unit according to claim 1 and including, a wafer removably mounted in the socket and forming the smaller segment of the hole.

4. A socket wrench according to claim 3 wherein the wafer constitutes stop means preventing the key and compression spring from falling out through the front end of the hole.

5. A socket wrench unit according to claim 3 wherein, the front recess is a long recess, the wafer is positioned in the front recess at the rear end of the latter leaving a free terminal recess at the extreme front end of the hole, and the wafer forming the rear end surface of the terminal recess, the wafer has a polygonal external surface, complementary to the inner surface of the front recess and a polygonal internal surface complementary to the external surface of the key.

6. A socket wrench unit according to claim 4 wherein, upon removal of the wafer from the socket, the key and compression spring are insertable into and removable from the hole through the front end thereof.

7. A socket wrench unit according to claim 6 wherein, the hole includes a main central segment immediately rearwardly of the front recess, and the main central segment forms a forwardly facing shoulder that constitutes a stop for limiting rearward movement of the wafer.

8. A socket wrench set unit according to claim 5 and including, removable means in the socket at the forward end of the rear recess preventing the drive unit from escaping through the rear end of the hole, and the socket being devoid of any means, such as a set screw and separate from said first removable retainer, for securing the key in position.

9. A socket wrench unit according to claim 1 wherein, the socket is of one-piece construction, and includes a radially inwardly directional body element forming the small segment of the hole, and said body element limits forward movement of the key.

10. A socket wrench unit according to claim 9, wherein, the key has a head on its rear end engageable with said body element, and a retainer is removably positioned in the socket and constitutes said stop element, said key and spring means being capable, after removal of the retainer, of being removed from the socket through the rear end of the latter.

11. A socket wrench according to claim 1, wherein, the socket has an internal rearwardly facing shoulder at the rear end of said smaller hole, the key has a head on its rear end engageable with said shoulder, and when it is so engaged, the key assumes said full forward position.

12. A socket wrench according to claim 1 wherein, the socket includes a portion defining the segment of the hole that is of relatively smaller transverse dimension, rearwardly of the front recess, of polygonal shape, complementary to the key and slidingly receiving the key, the socket has a rearwardly facing shoulder at a rear end of said segment of the main hole, the key has a first removable retainer at its rear end preventing the key from escaping through the front end of the socket.

* * * * *